US010583339B2

(12) United States Patent
Farina et al.

(10) Patent No.: US 10,583,339 B2
(45) **Date of Patent: *Mar. 10, 2020**

(54) MULTI-PLY TOWEL AND HOLDER FOR THE SAME

(71) Applicant: Forward and Findable, LLC, Alpharetta, GA (US)

(72) Inventors: Susan P. Farina, Johns Creek, GA (US); Judith T. Bardis, Johns Creek, GA (US)

(73) Assignee: FORWARD AND FINDABLE, LLC, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/401,837

(22) Filed: May 2, 2019

(65) Prior Publication Data

US 2019/0255403 A1 Aug. 22, 2019

Related U.S. Application Data

(63) Continuation of application No. 16/107,367, filed on Aug. 21, 2018, now Pat. No. 10,322,325.
(Continued)

(51) Int. Cl.
*A63B 57/60* (2015.01)
*A63B 47/04* (2006.01)
(Continued)

(52) U.S. Cl.
CPC ..... *A63B 57/60* (2015.10); *A41F 1/002* (2013.01); *A47K 10/02* (2013.01); *A47K 10/12* (2013.01);
(Continued)

(58) Field of Classification Search
CPC ..... Y10T 428/24008; Y10T 24/32; A44D 2203/00; A41F 1/002; A47L 13/10; A47L 13/16; A47K 7/02; A47K 10/02; A47K 10/025; A47K 10/12; A47K 10/14; A47K 2201/00; A47K 2201/02; B08B 1/00; B08B 1/001; B08B 1/006; A63B 47/04; A63B 2047/043; A63B 57/00; A63B 57/30; A63B 57/35; A63B 57/353; A63B 57/60; A63B 2057/605; A63B 60/36
(Continued)

(56) References Cited

U.S. PATENT DOCUMENTS 5,331,705 A 7/1994 Melov
7,322,068 B1 1/2008 Kim
(Continued)

OTHER PUBLICATIONS

International Search Report and Written Opinion dated Nov. 2, 2018 in International Patent Application No. PCT/US18/47299.

*Primary Examiner* — Mark Spisich
(74) *Attorney, Agent, or Firm* — Morris, Manning & Martin, LLP; Bryan D. Stewart

(57) ABSTRACT

The present apparatus includes a towel that is detachably connected to a clip and/or a marker. In various embodiments, the towel includes three layers: a first layer for cleaning, a second layer connected to the first layer, and a third layer that acts as moisture barrier between the first layer and the second layer. In some embodiments, the towel may be detachably connected to a clip via an embedded magnet, such that the towel may attach to a user's clothing for easy use.

12 Claims, 9 Drawing Sheets

Related U.S. Application Data

(60) Provisional application No. 62/548,561, filed on Aug. 22, 2017.

(51) Int. Cl.

| | |
|---|---|
| ***A63B 60/36*** | (2015.01) |
| ***A63B 57/35*** | (2015.01) |
| ***A47L 13/16*** | (2006.01) |
| ***A41F 1/00*** | (2006.01) |
| ***A47K 10/02*** | (2006.01) |
| ***A47K 10/12*** | (2006.01) |
| ***B08B 1/00*** | (2006.01) |
| *A63B 57/50* | (2015.01) |

(52) U.S. Cl.

CPC ..... *A47L 13/16* (2013.01); *A63B 47/04* (2013.01); *A63B 57/35* (2015.10); *A63B 60/36* (2015.10); *B08B 1/006* (2013.01); *A44D 2203/00* (2013.01); *A63B 57/50* (2015.10); *A63B 2209/00* (2013.01); *A63B 2209/08* (2013.01); *Y10T 24/32* (2015.01); *Y10T 428/24008* (2015.01)

(58) Field of Classification Search

USPC .... 15/118, 208, 209.1, 210.1; 224/183, 932; 24/279; 248/229.16, 241.18, 316.8

See application file for complete search history.

(56) References Cited

U.S. PATENT DOCUMENTS

| | | | | |
|---|---|---|---|---|
| 7,955,683 | B1 | 6/2011 | Ferrell | |
| 2001/0037542 | A1 | 11/2001 | Elliott | |
| 2005/0217048 | A1* | 10/2005 | Elie ..... | A47K 10/02 15/209.1 |
| 2008/0047639 | A1 | 2/2008 | Fox | |
| 2008/0190975 | A1 | 8/2008 | Naughton | |
| 2009/0151105 | A1 | 6/2009 | Bohannon | |
| 2010/0095423 | A1 | 4/2010 | Lucas | |
| 2010/0306984 | A1 | 12/2010 | Fiore | |
| 2012/0256067 | A1 | 10/2012 | Dastrup | |
| 2014/0061261 | A1 | 3/2014 | Yakeley | |
| 2014/0143935 | A1 | 5/2014 | Rose | |
| 2016/0114225 | A1 | 4/2016 | Brown et al. | |

* cited by examiner

MULTI-PLY TOWEL AND HOLDER FOR THE SAME

CROSS REFERENCE TO RELATED APPLICATIONS

This application is a continuation of U.S. patent application Ser. No. 16/107,367, filed Aug. 21, 2018, entitled "MULTI-PLY TOWEL AND HOLDER FOR THE SAME,", now U.S. Pat. No. 10,322,325, which claims priority to and the benefit under 35 U.S.C. § 119 of U.S. Provisional Patent Application No. 62/548,561, filed Aug. 22, 2017, and entitled "MULTI-PLY TOWEL AND HOLDER FOR THE SAME," each of which are incorporated by reference herein in entirety.

TECHNICAL FIELD

The present disclosure relates generally to a cleaning apparatus.

BACKGROUND

Sports equipment designed to be used outdoors (like golf clubs) can get dirty with regular use and require constant cleaning to perform at an optimum level. Almost every time a golfer strikes a golf ball, varying amounts of dirt accumulate on the club face. This dirt can become impacted in the grooves or merely sit on the club face and might need to be cleaned after each swing. Likewise, golf balls get dirty during play and require cleaning when allowed by the rules. Many golfers carry golf towels on their bags to clean their golf clubs and balls.

Most of golf towels on the market have a grommet in the corner and are secured to the golf bag with a carabiner that protrudes through the grommet and through a portion of the golf bag, such as a handle or the like. One of the disadvantages of these towels is that the towel is always attached to the golf bag and not attached on the person of the golfer. Additionally, the golf towel may include only one type of material.

Therefore, there is a long-felt but unresolved need for an apparatus that includes a towel that can be carried on a person (such as a golfer, runner, fitness enthusiast, etc.) and easily used.

BRIEF SUMMARY OF THE DISCLOSURE

Briefly described, and according to one embodiment, aspects of the present disclosure generally relate to a towel that includes a first layer, a second layer engaged to the first layer, and a cavity formed between the first layer and the second layer. An optional third layer is disposed between the first layer and the second layer. In some embodiments, the third layer is a moisture barrier that helps prevent moisture from traveling between the first layer and the second layer, keeping the second layer dry and clean if the first layer is wet and dirty.

According to various embodiments, the towel includes a first layer that may be composed of microfiber terrycloth. The second layer of the towel may be composed of a textured absorbent microfiber fabric. In various embodiments, the towel may be rectangular and/or square in shape.

In at least one embodiment, the apparatus disclosed herein includes a magnetic clip with an upper portion, a first end extending downward from the upper portion, and a second end extending downward from the upper portion and opposite the first end. In some embodiments, a magnet is disposed on an exterior side of either the first end and/or the second end. In particular embodiments, the magnetic clip includes one or more arms, a hinge, and one or more magnets embedded within the one or more arms.

Generally, in one or more embodiments, the magnetic clip secures a towel with a magnet embedded therein to another object (e.g., a user's pocket, pants, a backpack, etc.). As will be understood from discussions herein, in some embodiments, the clip attaches to the towel by the magnet embedded therein.

According to one embodiment of the present disclosure, the magnetic clip includes a hinge. In at least one embodiment of the present disclosure, the magnetic clip includes metal components and one or more magnets. In one or more embodiments, the magnetic clip includes plastic components and one or more magnets.

According to yet another embodiment of the present disclosure, the apparatus includes a ball marker for the purpose of marking the position of a golf ball when the ball is lifted on the putting green. In at least one embodiment, the apparatus disclosed herein includes another suitable marker or the like.

These and other aspects, features, and benefits of the claimed disclosure(s) will become apparent from the following detailed written description of the preferred embodiments and aspects taken in conjunction with the following drawings, although variations and modifications thereto may be effected without departing from the spirit and scope of the novel concepts of the disclosure.

According to a first aspect, an apparatus for cleaning surfaces and that is attachable to a user's clothing includes: A) a generally rectangular towel including: 1) a first layer including low to medium pile microfiber terrycloth; 2) a second layer including a textured microfiber fabric; 3) a moisture barrier disposed between the first layer and the second layer for preventing moisture from traveling between the first layer and the second layer, wherein the first layer, the second layer, and the moisture barrier are bound together along an edge of each of the first layer, the second layer, and the moisture barrier; and 4) a towel magnet, wherein the towel magnet is a generally circular magnet encased in plastic and disposed between the first layer and the second layer; and B) a clip including: 1) a first arm including at least one clip magnet for detachably connecting to the towel magnet; and 2) a second arm connected to the first arm via a hinge.

According to second aspect, the apparatus of the first aspect or any other aspect, wherein the moisture barrier includes polyester and plastic. According to a third aspect, the apparatus of the second aspect or any other aspect, wherein the plastic casing of the towel magnet is sewn to the first layer, the second layer, and/or the moisture barrier. According to a fourth aspect, the apparatus of the third aspect or any other aspect, wherein the second arm of the clip includes a second clip magnet. According to a fifth aspect, the apparatus of the fourth aspect, wherein the clip includes plastic encasing the at least one clip magnet of the first arm and the second clip magnet of the second arm. According to a sixth aspect, the apparatus of the fifth aspect or any other aspect, wherein the clip is reversible via the hinge. According to a seventh aspect, the apparatus of the sixth aspect or any other aspect, wherein the apparatus further includes a ball marker. According to an eighth aspect, the apparatus of the seventh aspect or any other aspect, wherein the ball marker is generally circular in shape and includes ferromagnetic materials. According to a ninth aspect, the apparatus of the eighth aspect or any other aspect, wherein the ball marker is detachably connected to the towel magnet.

According to a tenth aspect, an apparatus for cleaning surfaces and that is attachable to a user's clothing, the apparatus including: A) a clip for attaching to a user's clothing, the clip including: 1) a first arm including at least one clip magnet for detachably connecting to a towel magnet; and 2) a second arm connected to the first arm via a hinge, whereby the first arm and second arm are configured to receive a portion of the user's clothing there between; and B) a towel for cleaning a surface, the towel including: 1) a first layer including low to medium pile microfiber terrycloth; 2) a second layer including a textured microfiber fabric; 3) a moisture barrier disposed between the first layer and the second layer for preventing moisture from traveling between the first layer and the second layer, wherein the first layer, the second layer, and the moisture barrier are bound together along an edge of the first layer, the second layer, and the moisture barrier; and 4) a towel magnet, wherein the towel magnet is a generally circular magnet encased in plastic and sewn to one or more of the first layer, the second layer, and/or the moisture barrier.

According to an eleventh aspect, the apparatus of the tenth aspect or any other aspect, wherein the moisture barrier includes polyester and plastic. According to a twelfth aspect, the apparatus of the eleventh aspect or any other aspect, wherein the towel magnet is located proximate one edge of the towel. According to a thirteenth aspect, the apparatus of the twelfth aspect or any other aspect, wherein the second arm of the clip includes a second clip magnet. According to a fourteenth aspect, the apparatus of the thirteenth aspect or any other aspect, wherein the clip includes plastic encasing the at least one clip magnet of the first arm and the second clip magnet of the second arm. According a fifteenth aspect, the apparatus of the fourteenth aspect or any other aspect, wherein the clip is reversible via the hinge. According to a sixteenth aspect, the apparatus of fifteenth aspect or any other aspect, wherein the apparatus further includes a ball marker. According to a seventeenth aspect, the apparatus of the sixteenth aspect or any other aspect, wherein the ball marker is generally circular in shape and includes ferromagnetic materials. According to an eighteenth aspect, the apparatus of the seventeenth aspect or any other aspect, wherein the ball marker is detachably connected to the towel magnet. According to a nineteenth aspect, the apparatus of the eighteenth aspect or any other aspect, wherein the at least one clip magnet is a N45 rare earth neodymium magnet or a N52 rare earth neodymium magnet. According to a twentieth aspect, the apparatus of the nineteenth aspect or any other aspect, wherein the first layer, the second layer, and the moisture barrier are bound together by one or more of thread and adhesive.

According to a twenty-first aspect, a method for using a detachable towel apparatus including: A) attaching a towel to a user's clothing via a clip, the clip including: 1) a first arm including at least one clip magnet for detachably connecting to a towel magnet; and 2) a second arm connected to the first arm via a hinge, whereby the first arm and second arm are configured to receive a portion of the user's clothing there between; and B) attaching a towel to the clip via a towel magnet via the at least one clip magnet, the towel including: 1) a first layer including low to medium pile microfiber terrycloth; 2) a second layer including a textured microfiber fabric; 3) a moisture barrier disposed between the first layer and the second layer for preventing moisture from traveling between the first layer and the second layer, wherein the first layer, the second layer, and the moisture barrier are bound together along an edge of the first layer, the second layer, and the moisture barrier; and 4) the towel magnet, wherein the towel magnet is a generally circular magnet encased in plastic and sewn to one or more of the first layer, the second layer, and/or the moisture barrier.

According to a twenty-second aspect, the method of the twenty-first aspect, wherein the method further includes attaching a ball marker to the towel via the towel magnet.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
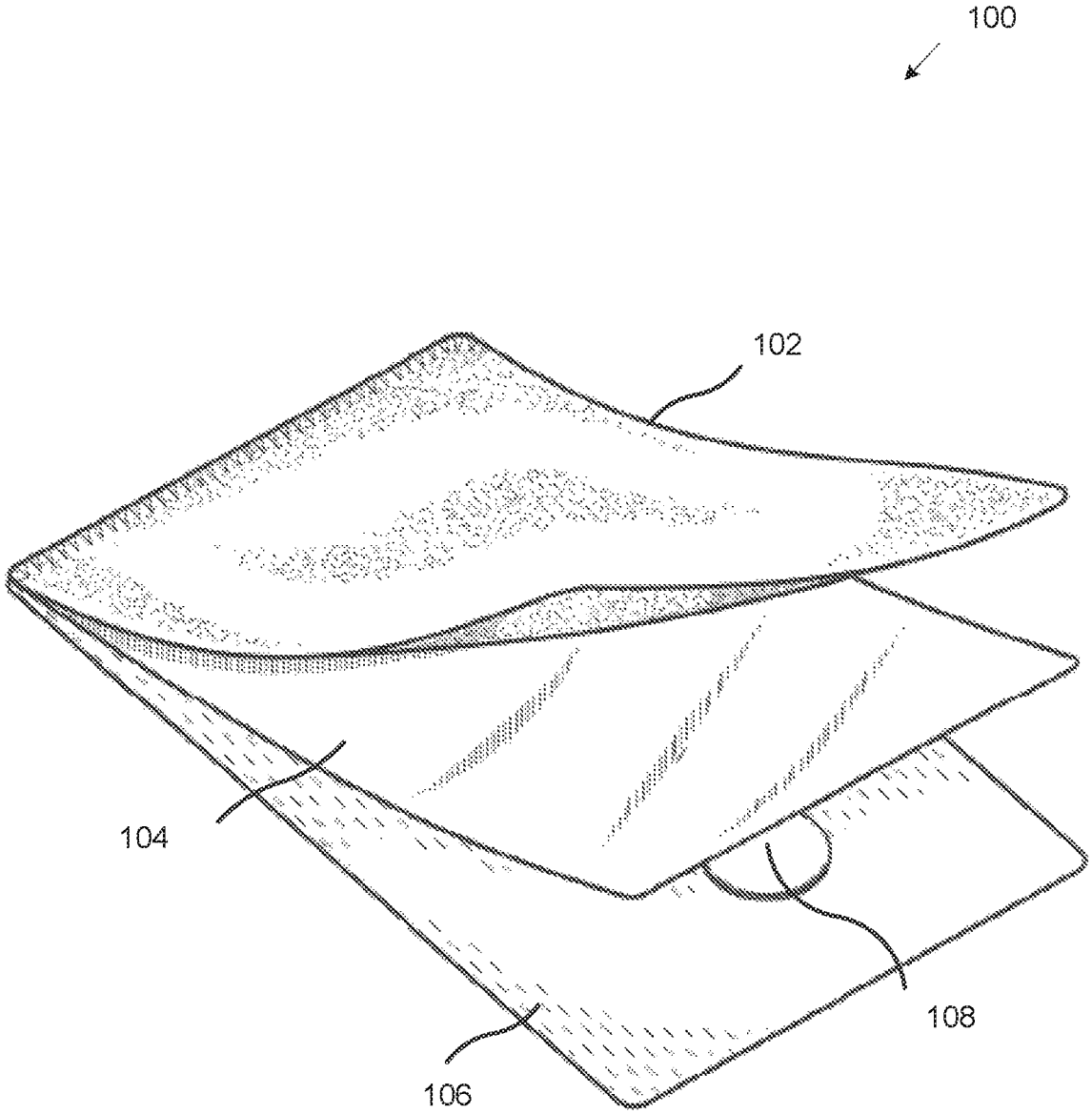
FIG. 1 illustrates various layers of a towel, according to an embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Overview

Aspects of the present disclosure generally relate to a towel, a clip, a magnetic apparatus, and more specifically to a towel that is secured, such as through magnetism, to a clip that may be engaged to the user's belt or other clothing.

In various embodiments, the disclosed towel includes a first layer, a second layer engaged to the first layer, and a cavity formed between the first layer and the second layer. An optional third layer is disposed between the first layer and the second layer. In at least one embodiment, the third layer is a moisture barrier for preventing moisture from traveling between the first layer and the second layer and keeping the second layer dry and clean if the first layer is wet and dirty.

In one embodiment, one side of the towel that represents one layer may be damp, and/or a particular material for wiping a surface, such as a golf club and ball. In various embodiments, a second side of the towel that represents a second layer is designed to remain dry (e.g., via the moisture barrier) and may hang against a user's clothing. In various embodiments, a third layer is disposed between the first layer and second layer for preventing moisture from the first layers from infiltrating the second layer (thus keeping a user's clothing clean from dirt and moisture).

In various embodiments, the disclosed magnetic clip includes an upper portion, a first end extending downward from the upper portion, and a second end extending downward from the upper portion and opposite the first end. In some embodiments, a magnet is disposed on an exterior side of either the first end and/or the second end. In various embodiments, a magnetic clip may be used to secure a towel (e.g. golf towel), to the clothing and/or garment accessories (e.g. backpack or purse) of a user during activity. In various embodiments, the clip includes a hinge. In some embodiments, the hinged clip can include metal, plastic and/or any flexible materials.

According to yet another embodiment of the present disclosure, the disclosed apparatus includes a towel containing a magnetized device that binds with the magnet of the clip for selectively securing the towel to the clip.

While uses for golf and golfers are exemplary and disclosed herein, the towel and clip can be used for any suitable activity, including, but not limited to outdoor activities and sports.

Exemplary Embodiments

Referring now to the figures, for the purposes of example and explanation of the fundamental processes and components of the disclosed systems and methods, reference is made to FIG. 1, which illustrates various layers of a towel, according to an embodiment of the present disclosure. According to at least one embodiment, the various layers of the towel 100 are for a) cleaning a surface (e.g., golf ball, golf club, runner's face, etc.); b) preventing moisture from passing through the towel; and c) resting against a user's clothing (or a second suitable use, such as scrubbing or the like).

In one embodiment, the towel 100 is dual sided and may include three-layers that are generally rectangular or generally square, but can have any other suitable shape. In various embodiments, the first layer 102 may be a microfiber terrycloth. In some embodiments, the second layer 106 may be a textured absorbent microfiber fabric. In one or more embodiments, the towel may include a magnet 108 between the first layer 102 and the second layer 106. In various embodiments, the optional third layer 104 is a moisture barrier disposed between the first layer 102 and the second layer 106. As will be understood from discussions herein, the layers of the towel may be any suitable material.

As illustrated in FIG. 1, the towel includes a magnet 108 between the first layer 102 and the second layer 106. In various embodiments, a pocket may be sewn into either the interior side or the exterior side of a layer (102, 106). The magnet 108 may be circular in shape, but may also have any other shape. In at least one embodiment, placement of the magnet 108 may be anywhere on or within the towel 100. In various embodiments, the magnet 108 may be placed in an upper corner of the towel 100 and/or on either side of the towel 100.

In some embodiments, the magnet 108 is engaged to the textured absorbent microfiber fabric of the second layer 106 so that the dry side of the towel 100 is adjacent the user's clothing therefore keeping the microfiber terrycloth of the first layer 102 away from the user's clothing.

It should be noted that other fabrics may be utilized for the layers (102, 106). In various embodiments, the first layer 102 may be manufactured from microfiber terrycloth that is a versatile microfiber cleaning material for cleaning the golf clubs. Generally, microfiber terrycloth may have a low to medium to high pile. In particular embodiments, the microfiber terrycloth has a medium pile and may be used effectively wet or dry. In at least one embodiment, the microfiber terrycloth's high absorbency allows for cleaning effectively while damp. In one or more embodiments, the absorbent microfiber fabric of the second layer 106 has a textured surface that can be utilized for scrubbing (e.g., a golf club, a golf ball, etc.).

In various embodiments, the layers of the towel 100 may be bound, such as stitched, sealed, fastened, etc. with stitching or other fastening means, such as a bonding adhesive or hot sealing. In various embodiments, each layer includes a top end, a bottom end, and two sides each with an outer edge. In one embodiment, the first layer 102 and the second layer 106 are bound at the top end, bottom end, and two sides to each other, creating a cavity between the first layer 102 and the second layer 106. In one embodiment, the moisture barrier 104 is housed within the cavity. In various embodiments, the moisture barrier 104 is a moisture and allergen barrier that may include polyester material with a thin film. Alternatively, the moisture barrier 104 may be bound to the first layer 102 and the second layer 106.

In various embodiments, the first layer 102 may include microfiber terrycloth. In some embodiments, the second layer 106 includes a texture microfiber. In at least one embodiment, the moisture barrier 104 allows the towel 100 to maintain a wet portion, such as either the first layer 102 or second layer 106, while keeping the opposite portion dry and preventing the liquid from progressing from one side to the second side.

According to a particular embodiment, during use, the first or second layer (102, 106) may be wet or dirty. In at least one embodiment, the moisture barrier 104 prevents the opposed layer from becoming wet and dirty. In various embodiments, the towel 100 and a clip (not shown in FIG. 1) are designed to be used on the person of a user and adjacent the user's clothing, such that the moisture barrier 104 allows one layer (102, 106) to be wet and dirty, but facing away from the user, and the layer (102, 106) adjacent the clothing of the user prevents the user's clothing from becoming wet or dirty (e.g., by preventing moisture from passing from the layer facing away from the user to the layer adjacent the user).

Figure 2:
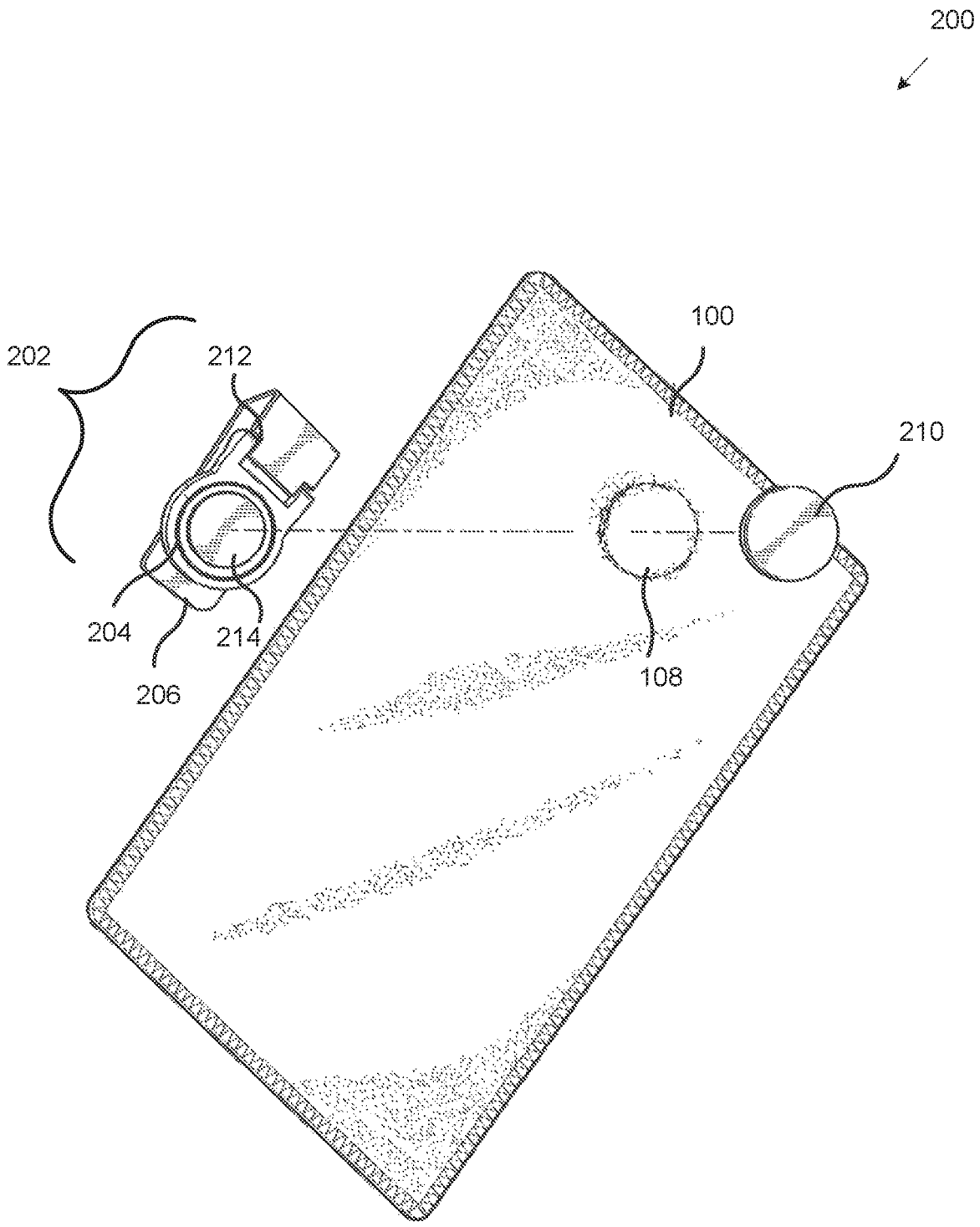
FIG. 2 illustrates a perspective view of a towel, a hinged magnetic clip, and a ball marker, according to an embodiment of the present disclosure.

FIG. 2 illustrates a perspective view of a towel, a hinged magnetic clip, and a ball marker, according to an embodiment of the present disclosure. As further discussed herein, in one embodiment, the apparatus may include a ball (or any suitable) marker 210. In at least one embodiment, the ball marker 210 may be engaged to the magnet 108 of the towel 100. In some embodiments, the ball marker 210 may be engaged to the magnet 214 of the hinged clip 202.

As depicted in FIG. 1, the towel 100, in at least one embodiment, includes a magnet 108 between the first layer and the second layer of the towel 100. In various embodiments, the magnet 108 has a strong enough magnetic adhesion force per unit area so that it clings tightly to the hinged clip 202 worn by the user and a ball marker 210. In some embodiments, the magnet 108 has a diameter that may be greater than, less than or equal to about 10 mm to 30 mm. In particular embodiments, the magnet 108 has a diameter that may be about 20 mm. In at least one embodiment, the magnet 108 may be enclosed/encased within a plastic (e.g., PVC or the like) pouch that may be sewn directly into one or more layers of the towel 100 allowing for machine washing and drying.

In one embodiment, the towel 100 may be selectively secured to a hinged clip 202 (or any suitable magnetic clip, such as the clip discussed in regards to FIGS. 4-7). In various embodiments, the hinged clip 202 includes a first end 204 and a second end 206. The first end 204 and the second end 206 are operatively connected by a hinge 212 for allowing the first end 204 to extend outwardly from the second end 206. In at least one embodiment, the hinge 212 allows the clip 202 to have a first position and a second position. In various embodiments, the hinge 212 allows the user to extend the second end 206 away from the first end 204 allowing the user to easily attach the clip 202 to clothing or another area, such as a waistband or pocket.

In the embodiment shown in FIG. 2, the clip 202 may be attached to a user (e.g., waistband, pocket, etc.) with the magnet 214 facing away from the user. In these embodiments (and others), the towel 100 detectably connects to the magnet 214 via a first side of the magnet 108 (embedded in the towel 100). Continuing with this embodiment, the ball maker 210 detachably connects to a second side of the magnet 108, such that the towel 100 and ball marker 210 are attached to a user via the clip 202 and magnets 214 and 108.

Figure 3A:
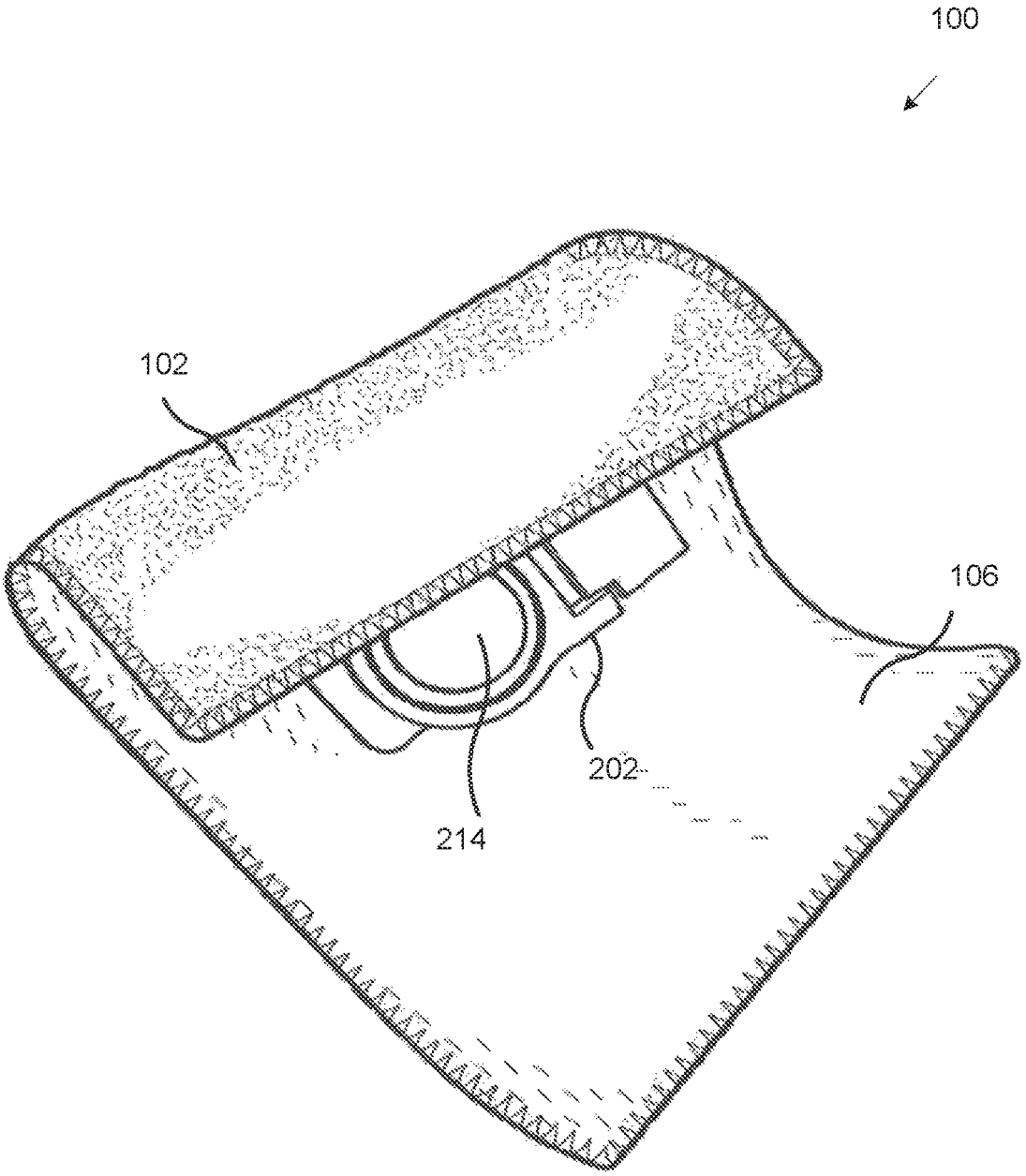
FIG. 3A illustrates a perspective view of a towel and a hinged magnetic clip in a partially rolled configuration, according to an embodiment of the present disclosure.
Figure 3B:
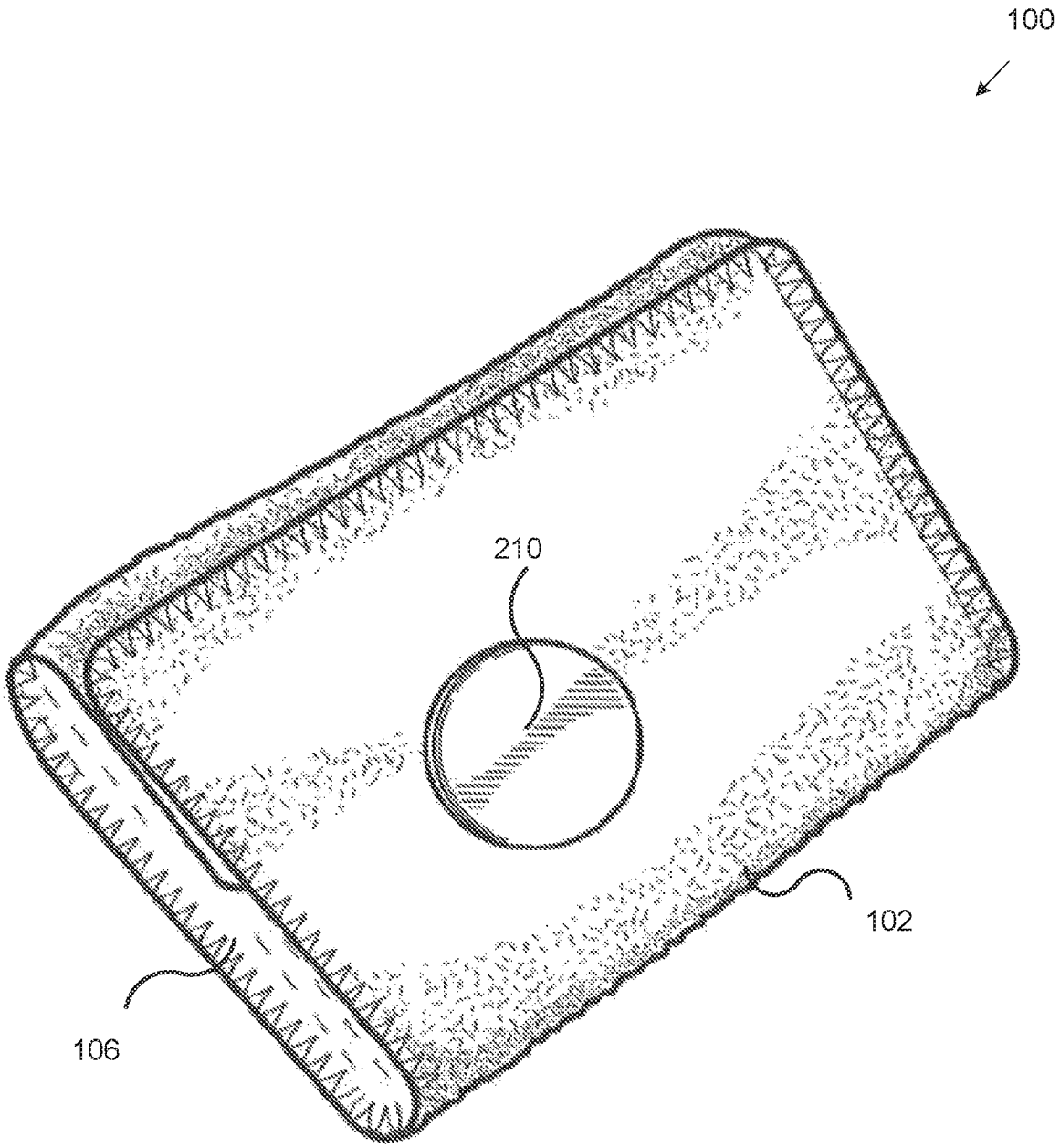
FIG. 3B illustrates a perspective view of a towel, a hinged magnetic clip, and a ball marker in a full rolled configuration, according to an embodiment of the present disclosure.

FIG. 3, which includes FIGS. 3A and 3B, illustrates an exemplary storage method of the present towel, clip, and ball marker. FIG. 3A illustrates a perspective view of a towel 100 and a hinged magnetic clip 202 in a partially rolled configuration, according to an embodiment of the present disclosure. In various embodiments, the clip 202 with the magnet 214 is placed magnet side-up on the second layer 106 of the towel 100 when the towel 100 is an extended position. In one embodiment, the towel 100 is rolled to a position so that the magnet (not shown) that is embedded within the towel between the first layer 102 and second layer 106 is attracted to and connects with the clip 202.

FIG. 3B illustrates a perspective view of a towel 100, a hinged magnetic clip (not shown), and a ball marker 210 in a full rolled configuration, according to an embodiment of the present disclosure. In various embodiments, the towel 100 is depicted as having been rolled and/or folded. In one embodiment, the magnet embedded within the first layer 102 and second layer 106 of the towel 100 is fully connected to the clip to maintain the security of the towel 100 in a closed position. In one embodiment, the ball maker 210 can be placed on the first layer 102 of the towel 100 and connected to the magnet embedded within the first layer 102 and second layer 106 of the towel 100.

Figure 4:
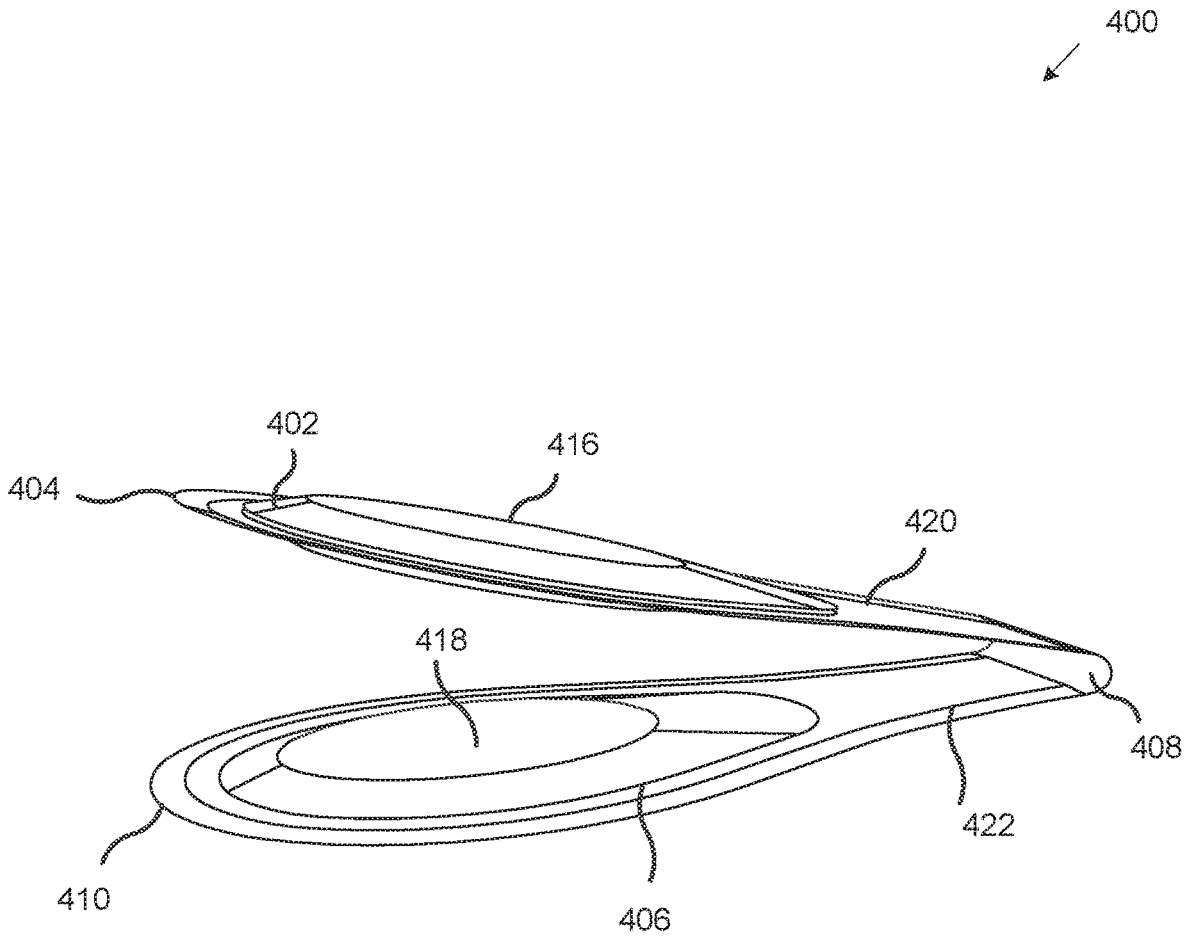
FIG. 4 illustrates a perspective view of a hinged magnetic clip in a partially open position, according to an embodiment of the present disclosure.

FIG. 4 illustrates a perspective view of a hinged magnetic clip 400 in a partially open position, according to an embodiment of the present disclosure. In various embodiments, the magnetic clip 400 has a first arm 420 with an embedded magnet 416. In various embodiments, the magnetic clip 400 has a second arm 422 with an embedded magnet 418. The magnets (416,418) may be secured to or within the arms (420, 422) via flexible materials through various manufacturing techniques (such as sewing or otherwise sealing the ends of the plastic arms). In some embodiments, the flexible materials may include but not limited to synthetic rubber, natural rubber, polycarbonate and/or plastic. In at least one embodiment, the magnets (416, 418), are embedded within the arms (420, 422) (e.g., the arms are produced with plastic portions of the arms surrounding the magnets). In some embodiments, the magnets (416, 418) are operatively connected to the arms (420, 422) externally (e.g., the magnets (416, 418) are connected to the outside or inside surfaces of the arms (420, 422)) via a suitable adhesive or the like.

As will be understood from discussions herein, the magnets (416,418) may be circular in shape, but may also have any suitable shape (e.g., square, rectangular, etc.). In various embodiments, the magnets (416,418) may be manufactured from N45 rare earth neodymium magnets or the like.

In various embodiments, the first arm 420 and second arm 422 have circular edges 404 and 410, respectively. In some embodiments, the first arm 420 and the second arm 422 may be connected via a hinge and/or connected at the middle bend section 408. In at least one embodiment, the magnetic clip 400 can be folded at the middle bend section 408 such that magnets 416 and 418 attract each other. In particular embodiments, the magnetic force of the two magnets (416, 418) draws them together forming a clipping function.

In regards to FIG. 4, the hinged clip 400 may be inserted into either the user's clothing and/or garment accessories (e.g. backpack or purse). In one embodiment, when the hinged clip 400 is secured to the user's clothing and/or garment, at least one embedded magnet (e.g., 418) will face the user and the other embedded magnet (e.g., 416) will extend outward from the user, such that at least one of the magnets can detachably connect to a towel with an embedded magnet (e.g., magnet 108 shown in FIG. 1).

As an example, the hinged clip 400 can be partially inserted into a pocket of the user during golf or can be clipped to the waistband of a runner. Continuing with this example, the hinged clip 400 is opened and the bottom surface 406 may be inserted into the pocket and/or waistband with the top surface 402 extending outwardly from the bottom surface 406. Once the bottom surface 406 is inserted into a pocket, in this example, the hinged clip 400 is returned to a closed position. Continuing with this example, the interior surface of the arm 420 may pinch the material of the pocket and/or waistband against the interior surface of the arm 422.

Continuing with the above example, once the hinged clip 400 is secured to a user (e.g., via a pocket and/or waistband), the towel 100 can be selectively secured to the hinged clip 400. In this example, the user may move the towel 100 near the hinged clip 400 until the magnetic forces between the magnet 108 embedded in towel 100 and the magnet 416 embedded in hinged clip 400 engage, selectively securing the towel 100 to the clip 400. Additionally, in this example, the ball marker 210 may also be engaged to the magnet 108 embedded in the towel 100 (e.g., on the opposite side of the towel 100 as the clip 400).

Figure 5:
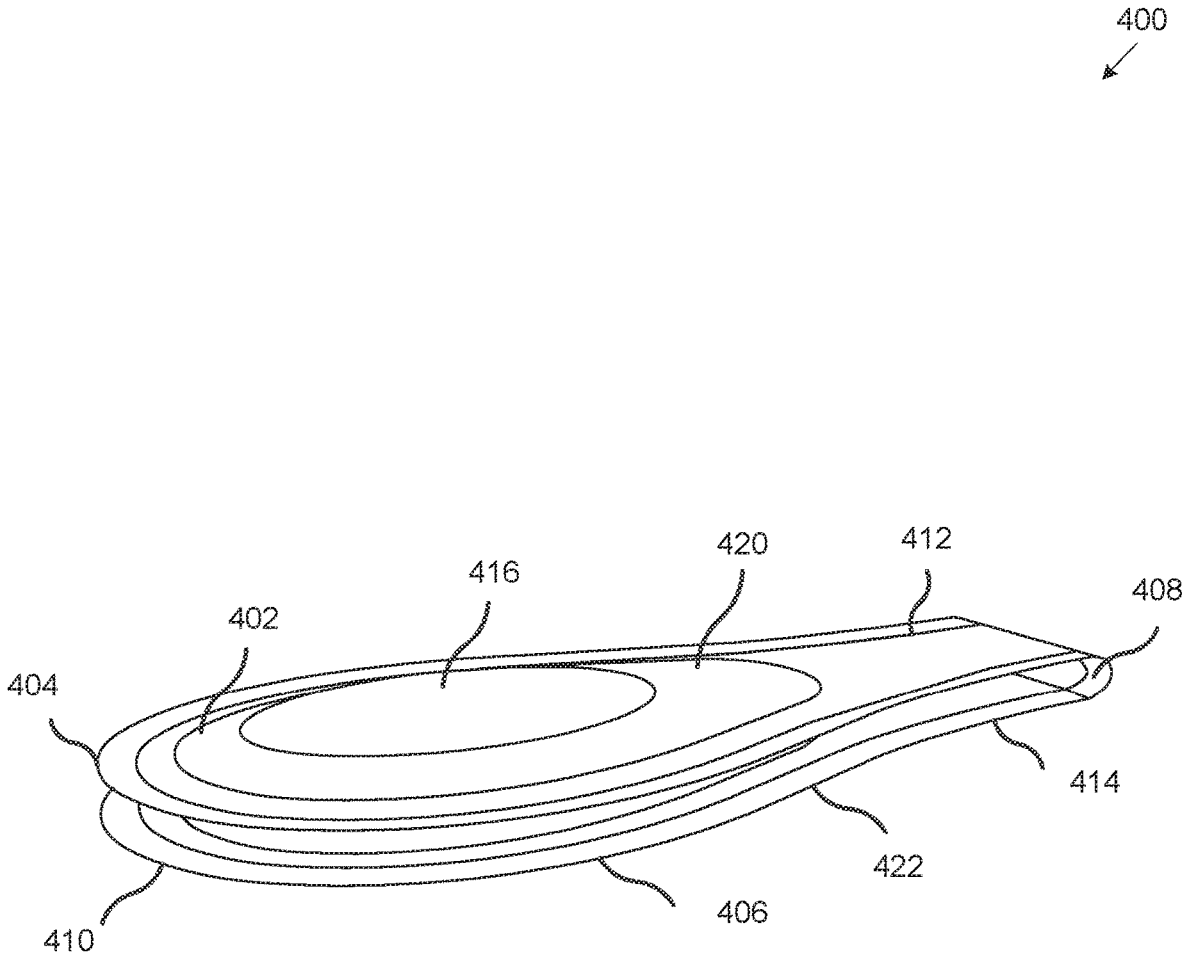
FIG. 5 illustrates a hinged magnetic clip in a closed or folded position, according to an embodiment of the present disclosure.

FIG. 5 illustrates a hinged magnetic clip in a closed or folded position, according to an embodiment of the present disclosure. In various embodiments, the magnetic clip 400 is bendable and used for securing a towel to the user's belt or clothing. In various embodiments, the magnetic clip 400 has a first arm 420 with top surface 402 and a second arm 422 with a bottom surface 406. In particular embodiments, the top surface 402 has a circular edge 404 and a rear edge 412. In some embodiments, the bottom surface 406 has a circular edge 410 and a rear edge 414. In one or more embodiments, the rear edges 412 and 414 of the top and bottom surfaces 402 and 406 are connected together by a hinged connecting member 408 so as to permit the insertion of the clip into the pocket (or accessory, waistband, etc.) of the user. In at least one embodiment, the top surface 402 and bottom surface 406 are substantially flat.

In various embodiments, the magnetic clip 400 may be manufactured from a variety of flexible but durable materials and in one embodiment may be constructed from any suitable plastic, rubber, and/or metal. In various embodiments, magnets (416, 418) are embedded within the arms (420, 422).

In various embodiments, the embedded magnets (416, 418) can be designed to have different magnetic field strength based on the use and/or application. In one embodiment, the user may be wearing clothing consisting of thicker material and may need a clip with a stronger magnetic force in order to secure the towel to the users clothing.

Figure 6:
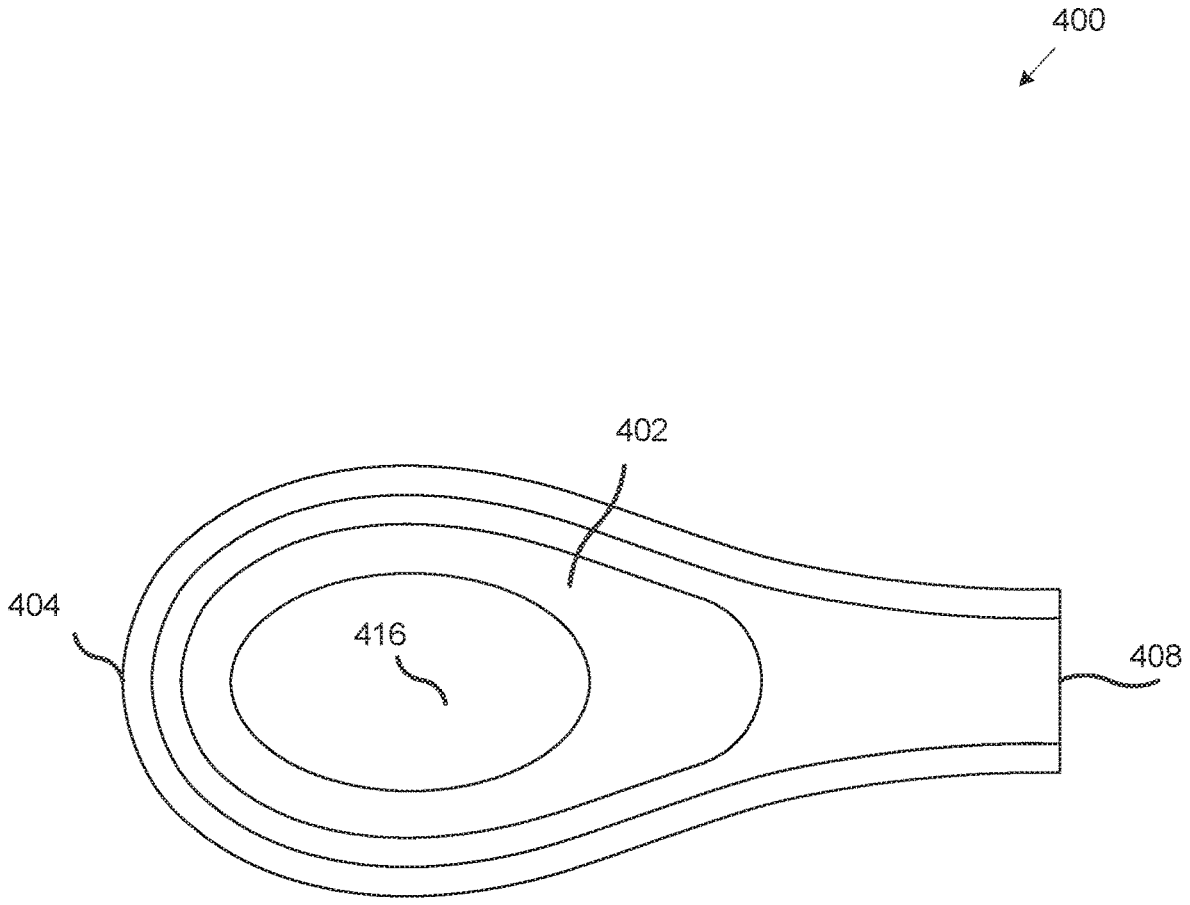
FIG. 6 illustrates a top view of a hinged magnetic clip in a closed or folded position, according to an embodiment of the present disclosure.

FIG. 6 illustrates a top view of a hinged magnetic clip in a closed or folded position, according to an embodiment of the present disclosure. As shown, the top surface of the clip 402 has a rounded edge 404 and rear hinged connecting member 408. In various embodiments, the clip 400 can employ a back and forth bending action at the rear hinged connecting member 408 allowing for an open and closed position. A towel or other suitable garment can be secured to the user by the embedded magnet 416.

Figure 7:
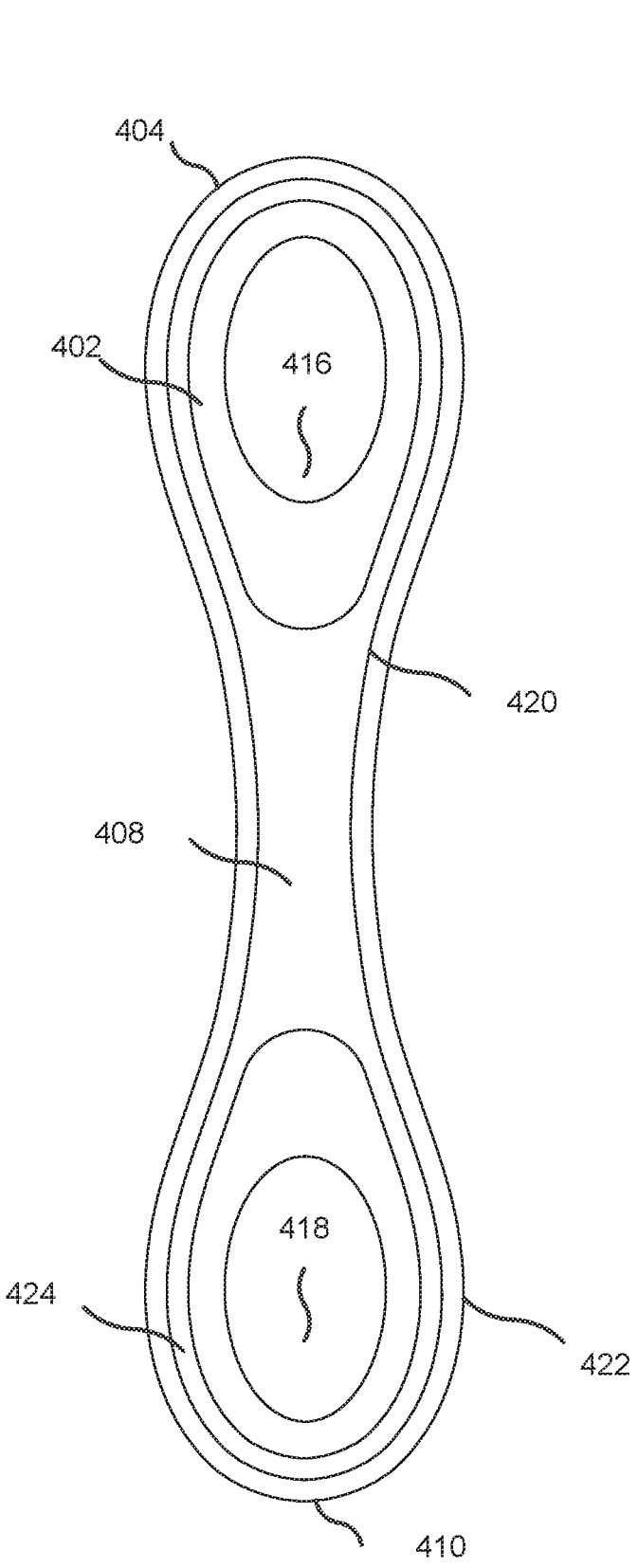
FIG. 7 illustrates a top view of a hinged magnetic clip in an unfolded or open position, according to an embodiment of the present disclosure.

FIG. 7 illustrates a top view of a hinged magnetic clip in an unfolded or open position, according to an embodiment of the present disclosure. As previously mentioned, the magnetic clip 400 may include various materials that can contribute to the flexibility of the clip 400. In at least one embodiment, the clip 400 may be flexible enough (or at least the middle bend section 408 may be flexible enough) for the clip 400 to lay completely flat and or bend nearly 360 degrees about the middle bend section 408. In one embodiment, the middle section 408 is subjected to bending action during the use of the clip and this section may be reinforced with a stronger but still flexible material to withstand the constant folding and unfolding action by the user.

Figure 8:
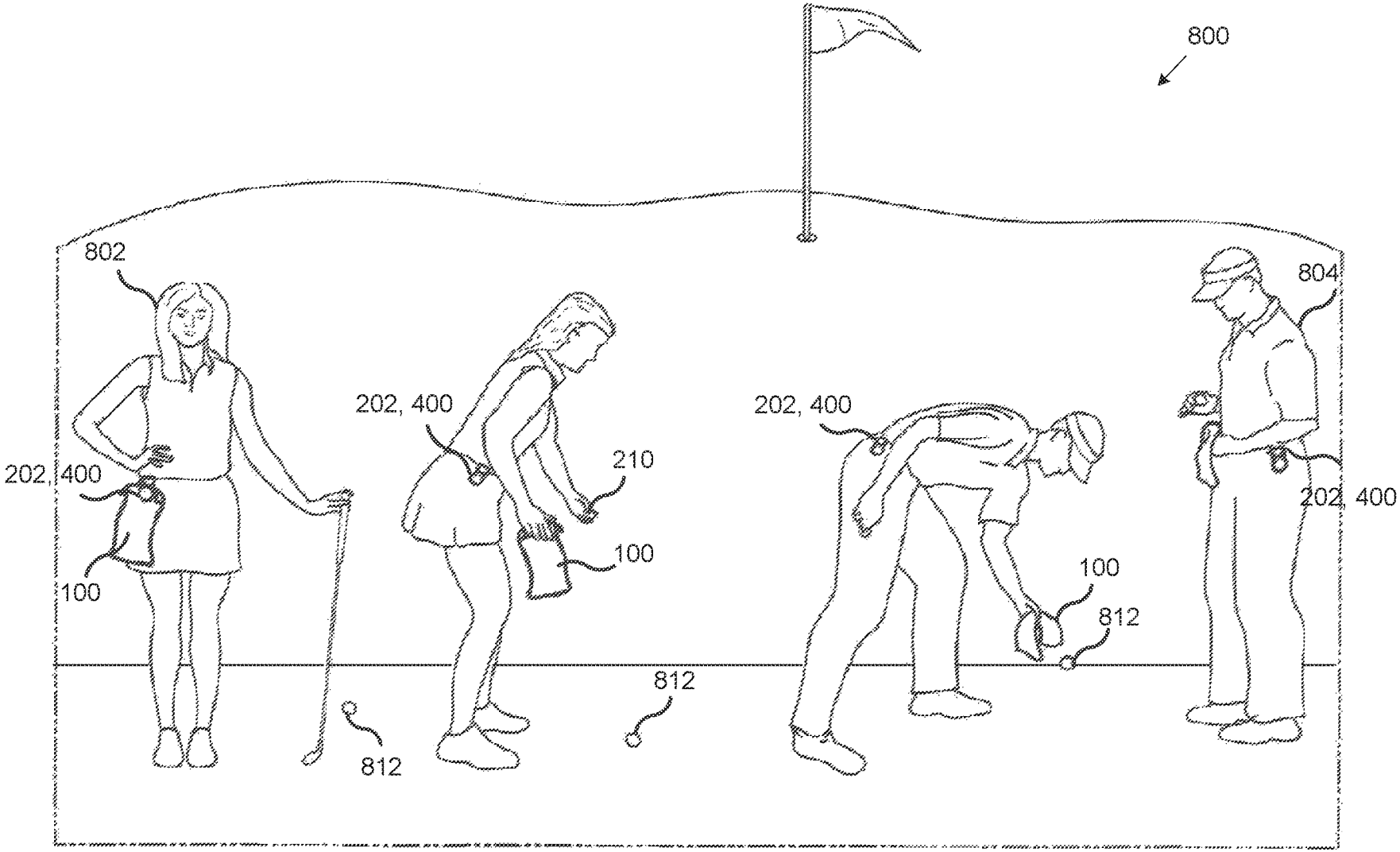
FIG. 8 illustrates an exemplary use-case of an embodiment of the apparatus disclosed herein.

FIG. 8 illustrates an exemplary use case of an embodiment of the apparatus disclosed herein. In one embodiment, the hinged magnetic clip 202 and/or 400 is designed to be worn by users 802 and 804 during an activity, such as golf. In at least one embodiment, during a round of golf, a towel 100 is designed to be carried on the person of the golfer. As discussed herein, in some embodiments, the towel 100 is engaged to the person by way of the magnetic clip (202, 400), and the towel 100 can be easily removed and returned to the magnetic clip (202, 400). According to a particular embodiment, once a user is finished using the towel 100, the user (e.g., user 802 and/or 804) can move the towel 100 near the clip (202, 400) and a magnet (e.g., magnet 108) embedded in the towel 100 can engage the magnet associated with the clip (202, 400) to selectively secure the towel 100 to the magnetic clip (202, 400).

In one embodiment, a ball marker 210 may also be engaged to the clip (202, 400) and/or towel 100. The ball marker 210 may be engaged to the magnet embedded in the towel 100 and/or a magnet operatively connected to the clip (202, 400). Generally, the ball marker 210 can be used as a placeholder for the golf ball 812 while users 802 and/or 804 use the towel to scrub the ball 812 clean. In at least one embodiment, the second layer (not shown) can be used to dry the golf ball if damped during the cleaning process.

Alternative Embodiments

In an alternative embodiment, the towel 100 defines a hole. In this embodiment, the hole may be surrounded by a grommet and, in particular embodiments, a steel binding can be inserted through the hole.

As will be understood, in some embodiments, the steel binding may include a top portion and a bottom portion. In various embodiments, the top portion may contain a frustoconical upper portion with a hollow column extending downward therefrom. In some embodiments, the bottom portion can contain a frustoconical upper portion with a hollow column extending downward therefrom. In one or more embodiments, the diameter of the column of the bottom portion is slightly smaller in diameter than the column of the top portion for allowing the column of the top portion for receiving the column of the bottom portion forming the steel binding. According to particular embodiments, the top portion of the steel binding may be on one side of the towel 100 and the bottom portion is on the other side of the towel 100 with each column extending through the hole in the towel 100. In various embodiments, the column of the bottom side is received within the column of the top portion and the top portion and the bottom portion are pushed together and enjoining the top portion and the bottom portion together forming the steel binding.

In at least one alternate embodiment, a towel and/or clip may include a metal portion that detachably connects to a corresponding magnet. In one such alternate embodiment the towel includes a metal portion and the metal portion of the towel detachably connects the towel to a corresponding magnet of the clip.

In another such alternate embodiment, the clip includes a metal portion and the towel includes an embedded magnet. In this embodiment (and others), the metal portion of the clip operatively/detachable connects to the magnet embedded within the towel.

As will be understood, the apparatus disclosed herein may include any suitable type of clip, which may be made from any suitable materials (metal, plastic, etc.). Further, the apparatus disclosed herein may include any suitable type of towel that is detachably connectable to a clip.

In a further embodiment, the disclosed apparatus may include a divot tool (e.g., instead of, or in addition to, the ball marker) and such divot tool may detachably connect to one or more other components of the disclosed apparatus (e.g., via a magnet, clip, or the like).

Conclusion

While various aspects have been described, additional aspects, features, and methodologies of the claimed apparatuses will be readily discernible from the description herein, by those of ordinary skill in the art. Many embodiments and adaptations of the disclosure and claimed inventions other than those herein described, as well as many variations, modifications, and equivalent arrangements and methodologies, will be apparent from or reasonably suggested by the disclosure and the foregoing description thereof, without departing from the substance or scope of the claims. Furthermore, any sequence(s) and/or temporal order of steps of various processes described and claimed herein are those considered to be the best mode contemplated for carrying out the claimed inventions. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed inventions. In addition, some steps may be carried out simultaneously, contemporaneously, or in synchronization with other steps.

The embodiments were chosen and described in order to explain the principles of the claimed inventions and their practical application so as to enable others skilled in the art to utilize the inventions and various embodiments and with various modifications as are suited to the particular use contemplated. Alternative embodiments will become apparent to those skilled in the art to which the claimed inventions pertain without departing from their spirit and scope. Accordingly, the scope of the claimed inventions is defined by the appended claims rather than the foregoing description and the exemplary embodiments described therein.

We claim:

1. An apparatus for cleaning surfaces and that is attachable to a user's clothing, the apparatus comprising:
- a generally rectangular towel comprising:
  - a first layer comprising microfiber terrycloth;
  - a second layer comprising a textured microfiber fabric;
  - a moisture barrier comprising plastic and disposed between the first layer and the second layer for preventing moisture from traveling between the first layer and the second layer; and
  - a towel magnet, wherein:
    - the towel magnet is a magnet disposed between the first layer and the second layer and encased in plastic;
    - the plastic casing of the towel magnet is sewn to one or more of the first layer, the second layer, and the moisture barrier; and
- a clip comprising:
  - a first arm comprising at least one clip magnet for detachably connecting to the towel magnet; and
  - a second arm comprising a second clip magnet and connected to the first arm via a hinge.

2. The apparatus of claim 1, wherein the clip comprises plastic encasing the at least one clip magnet of the first arm and the second clip magnet of the second arm.

3. The apparatus of claim 2, wherein the clip is reversible via the hinge.

4. The apparatus of claim 3, wherein the apparatus further comprises a ball marker.

5. The apparatus of claim 4, wherein the ball marker is detachably connected to the towel magnet.

6. An apparatus for cleaning surfaces and that is attachable to a user's clothing, the apparatus comprising:
- a clip for attaching to a user's clothing, the clip comprising:
  - a first arm comprising at least one clip magnet for detachably connecting to a towel magnet; and
  - a second arm comprising a second clip magnet and connected to the first arm via a hinge, whereby the first arm and second arm are configured to receive a portion of the user's clothing there between; and
- a towel for cleaning a surface, the towel comprising:
  - a first layer comprising microfiber terrycloth;
  - a second layer comprising a textured microfiber fabric;
  - a moisture barrier comprising plastic and disposed between the first layer and the second layer for preventing moisture from traveling between the first layer and the second layer; and
  - a towel magnet, wherein the towel magnet is a magnet encased in plastic sewn to one or more of the first layer, the second layer, and the moisture barrier, and is located proximate one edge of the towel.

7. The apparatus of claim 6, wherein the clip comprises plastic encasing the at least one clip magnet of the first arm and the second clip magnet of the second arm.

8. The apparatus of claim 7, wherein the clip is reversible via the hinge.

9. The apparatus of claim 8, wherein the apparatus further comprises a ball marker.

10. The apparatus of claim 9, wherein the ball marker is detachably connected to the towel magnet.

11. The apparatus of claim 10, wherein the at least one clip magnet is a N45 rare earth neodymium magnet or a N52 rare earth neodymium magnet.

12. The apparatus of claim 11, wherein the first layer, the second layer, and the moisture barrier are bound together by one or more of thread and adhesive.

* * * * *